US006745598B2

(12) United States Patent
Challis et al.

(10) Patent No.: US 6,745,598 B2
(45) Date of Patent: Jun. 8, 2004

(54) PRECISION DELIVERY SYSTEM

(75) Inventors: Simon Challis, Manchester (GB); Anura Fernando, Stalybridge (GB); Tilak Dias, Stockport (GB); William Cooke, Congleton (GB); Najmal Hassan Chaudhury, Sale (GB); John Geraghty, Manchester (GB); Steven Smith, Warrington (GB)

(73) Assignee: University of Manchester Institute of Science & Technology, Manchester (GB)

( * ) Notice: Subject to any disclaimer, the term of this patent is extended or adjusted under 35 U.S.C. 154(b) by 0 days.

(21) Appl. No.: 10/264,868

(22) Filed: Oct. 4, 2002

(65) Prior Publication Data

US 2003/0110812 A1 Jun. 19, 2003

Related U.S. Application Data

(63) Continuation of application No. PCT/GB01/01521, filed on Apr. 3, 2001.

(30) Foreign Application Priority Data

Apr. 6, 2000 (GB) ..... 0008304

(51) Int. Cl.[7] ..... D04B 15/48

(52) U.S. Cl. ..... 66/146; 66/125 R

(58) Field of Search ..... 66/125 R, 126 R, 66/127, 126 A, 132 R, 145 S, 146, 143, 144

(56) References Cited

U.S. PATENT DOCUMENTS

| | | | |
|---|---|---|---|
| 2,252,637 | A | 8/1941 | Lawson |
| 3,061,941 | A | 11/1962 | Goy et al. |
| 3,093,878 | A | 6/1963 | Fieldman |
| 3,175,375 | A | 3/1965 | Yazawa et al. |
| 3,213,470 | A | 10/1965 | Yasawa et al. |
| 3,241,343 | A | 3/1966 | Yazawa |

(List continued on next page.)

FOREIGN PATENT DOCUMENTS

| | | |
|---|---|---|
| DE | 24 30 741 | 1/1975 |
| DE | 24 44 973 | 4/1975 |
| DE | 36 29 699 A1 | 3/1988 |
| DE | 4102790 | 8/1991 |
| DE | 40 32 402 A1 | 4/1992 |
| DE | 44 13 750 A1 | 10/1994 |
| EP | 0 703 306 A1 | 3/1996 |
| FR | 74 33 617 | 10/1974 |
| GB | 1581827 | 12/1980 |
| GB | 1 592 646 | 7/1981 |
| JP | 52 08 5 545 A | 7/1977 |
| JP | 122840 | 10/1978 |
| JP | 61 102 421 | 5/1986 |
| JP | 61 102 422 | 5/1986 |
| JP | 61 102 423 | 5/1986 |
| WO | WO 92/07129 | 4/1992 |
| WO | WO 94/21849 | 9/1994 |
| WO | WO 95/32325 | 11/1995 |
| WO | WO 97/30200 | 8/1997 |
| WO | WO 97/38306 | 10/1997 |

OTHER PUBLICATIONS

International Search Report for PCT/GB 01/01521 mailed Aug. 23, 2001.
International Search Report for PCT/GB 00/02610 mailed Dec. 6, 2000.

*Primary Examiner*—Danny Worrell
(74) *Attorney, Agent, or Firm*—Wallenstein Wagner & Rockey, Ltd.

(57) ABSTRACT

A precision yarn (14) delivery system for the delivery of yarn from a yarn supply to a yarn utilising point, comprising a temporary yarn store (22) intermediate the supply and the utilisation point in which the yarn (14) is held under low tension and is fed from the store as required by the utilisation point.

34 Claims, 2 Drawing Sheets

U.S. PATENT DOCUMENTS 3,320,776 A 5/1967 Gorodissky et al.
3,349,578 A 10/1967 Greer et al.
3,449,809 A 6/1969 Shin
3,474,510 A 10/1969 Torsellini
3,563,064 A 2/1971 Yazawa
3,577,721 A 5/1971 Schmick
3,727,392 A 4/1973 Gibbon
3,746,226 A * 7/1973 Leclercq ..... 226/25
3,773,483 A 11/1973 Schmidt
3,783,596 A 1/1974 Waldkirch
3,783,649 A 1/1974 Yamamoto et al.
3,822,543 A 7/1974 Edagawa et al.
3,842,468 A 10/1974 Harrison
3,851,457 A 12/1974 Waters
3,908,920 A 9/1975 Hermanns
3,916,493 A 11/1975 Ethridge
3,917,540 A 11/1975 Pollitzer
3,965,511 A 6/1976 Fleissner
4,003,195 A 1/1977 Fernstrom et al.
4,010,529 A 3/1977 Honegger
4,064,684 A 12/1977 Nijhuis
4,138,840 A 2/1979 Greenway et al.
4,148,179 A 4/1979 Becker et al.
4,173,861 A 11/1979 Norris et al.
4,192,047 A 3/1980 Foster et al.
4,226,092 A 10/1980 Lüthi
4,286,394 A 9/1981 Gort
4,384,448 A 5/1983 Wilkie
4,408,445 A 10/1983 Wilkie
4,412,371 A 11/1983 Hagen et al.
RE31,705 E 10/1984 Morihashi
4,497,099 A 2/1985 Scott
4,570,312 A 2/1986 Whitener, Jr.
4,586,934 A 5/1986 Blalock et al.
4,624,102 A 11/1986 Bell, Jr.
4,870,813 A 10/1989 Nelson
4,953,800 A * 9/1990 Okubo et al. ..... 242/413.3
5,003,763 A 4/1991 Hallam et al.
5,054,174 A 10/1991 Krenzer
5,142,754 A 9/1992 Krenzer
5,193,335 A 3/1993 Mori
5,255,502 A * 10/1993 Iwade et al. ..... 57/22
5,287,606 A 2/1994 Ruef
5,404,706 A 4/1995 Ueno et al.
5,640,858 A * 6/1997 Komenda et al. ..... 66/126 R
5,709,910 A 1/1998 Argyle et al.
5,740,974 A * 4/1998 Conzelmann ..... 242/364.5
5,802,832 A 9/1998 Foster
6,032,335 A 3/2000 Harzenmoser et al.
6,370,922 B1 * 4/2002 Brach et al. ..... 66/136
6,397,444 B1 6/2002 Foster et al.
6,438,934 B1 8/2002 Foster et al.

* cited by examiner

PRECISION DELIVERY SYSTEM

This application is a continuation of International Application No. PCT/GB01/01521, with an international filing date of Apr. 3, 2001, now pending, and herein incorporated by reference.

This invention relates to yarn delivery systems, and in particular to a delivery system for the delivery of precise lengths of yarn from a yarn supply to a yarn utilising point at a rate required by that utilising point.

It is known in relation to various yarn processes to store a length of yarn in a storage device or accumulator disposed between a yarn supply and a yarn processing station or utilisation point. Such devices generally comprise a chamber into which the yarn is fed, generally by compressed air, and from which the yarn is withdrawn by the yarn processing or utilising devices. Within the chamber the yarn may accumulate in a succession of folds or layers. For many applications such arrangements may well be satisfactory. However, in the case of supplying yarn to a knitting machine, a primary aim in producing a high quality knitted product, i.e. as regards dimensions, pressure characteristics, stiffness and shape retention, is that of defined stitch length throughout the knitted fabric. Heretofore, yarn has been withdrawn from the supply or from the store by the knitting needles as required, but the problem of ensuring precision stitch length control has not been solved wholly satisfactorily in either case. This problem is particularly acute in the cases of fabrics knitted on flat-bed knitting machines and in the use of elastomeric yarns, which can extend by over 600%. Furthermore accumulation of fine, high modulus or elastomeric knitting yarn in layers or folds can lead to twisting or snarling of the yarn, which provides that the feed to the knitting machine is unsatisfactory or even breaks down.

It is an object of the present invention to provide a yarn delivery system from a yarn supply to a yarn utilising point at a precise rate required by that utilising point, which does not have the abovementioned disadvantages of known storage or accumulator devices. It is also an object of the invention to provide a yarn delivery system capable of delivering precise lengths of yarns such as elastomeric yarns, particularly to flat bed knitting machines.

The invention provides a precision yarn delivery system for the delivery of yarn from a yarn supply to a yarn utilising point, comprising a temporary yarn store intermediate the supply and the utilisation point in which the yarn is held under low tension and is fed from the store as required by the utilisation point.

The yarn in the store may allowed to relax at a tension less than that at which it is withdrawn from the supply, and may be held under a uniform substantially zero tension. The system may comprise a chamber in which the yarn is stored, and the yarn may be stored in the chamber under pneumatic control. The pneumatic control may be provided by suction applied to the chamber. The chamber may comprise an elongate tube, which may have a width to prevent twisting of the yarn therein. A yarn inlet to and a yarn outlet from the chamber may be at one end of the chamber, and the yarn may be constrained to form a single loop in the chamber. The suction may be applied to the chamber at the other end thereof.

The system may comprise an output feed device, which may be disposed spaced from the yarn outlet from the chamber. The output feed device may comprise a pair of feed rollers. The system may also comprise an input feed device, which may be disposed adjacent the yarn inlet to the chamber. The input feed device may comprise a pair of feed rollers. The input feed device and the output feed device may be driven by a common drive arrangement, and the input feed device may be driven at a higher speed than the output feed device. The drive arrangement may comprise gearing operable to determine the ratio of the speed of the input feed device to that of the output feed device. The gearing may be selectable dependent on the elasticity of the yarn to be stored. A motor may be disposed to drive the gearing, and the motor may be a precision servo motor or a stepper motor.

The invention also provides a knitting machine having a precision yarn delivery system for the delivery of yarn from a yarn supply to a knitting point, comprising a temporary yarn store intermediate the supply and the knitting point in which the yarn is held under low tension and fed from the store as required by the knitting point. The knitting machine may be a flat bed knitting machine.

The knitting machine may comprise a carriage operable to engage a selected carrier and to move the carrier along a rail of the machine in accordance with a signal from a control arrangement. The carrier may have the precision yarn delivery system mounted thereon. The carriage may have a motor and a coupler mounted thereon. The coupler may be operable to engage a shaft of the motor with gearing of the precision yarn delivery system when the carriage is engaged with the carrier. The coupler may be operated by means of electro pneumatic cylinders or by solenoids. Suction may be applied to the store whilst the carriage is in engagement with the carrier.

The system may comprise two stores and respective input feed devices, whereby two yarns may be fed to the knitting point.

The invention will now be described with reference to the accompanying drawings, in which.

Figure 1:
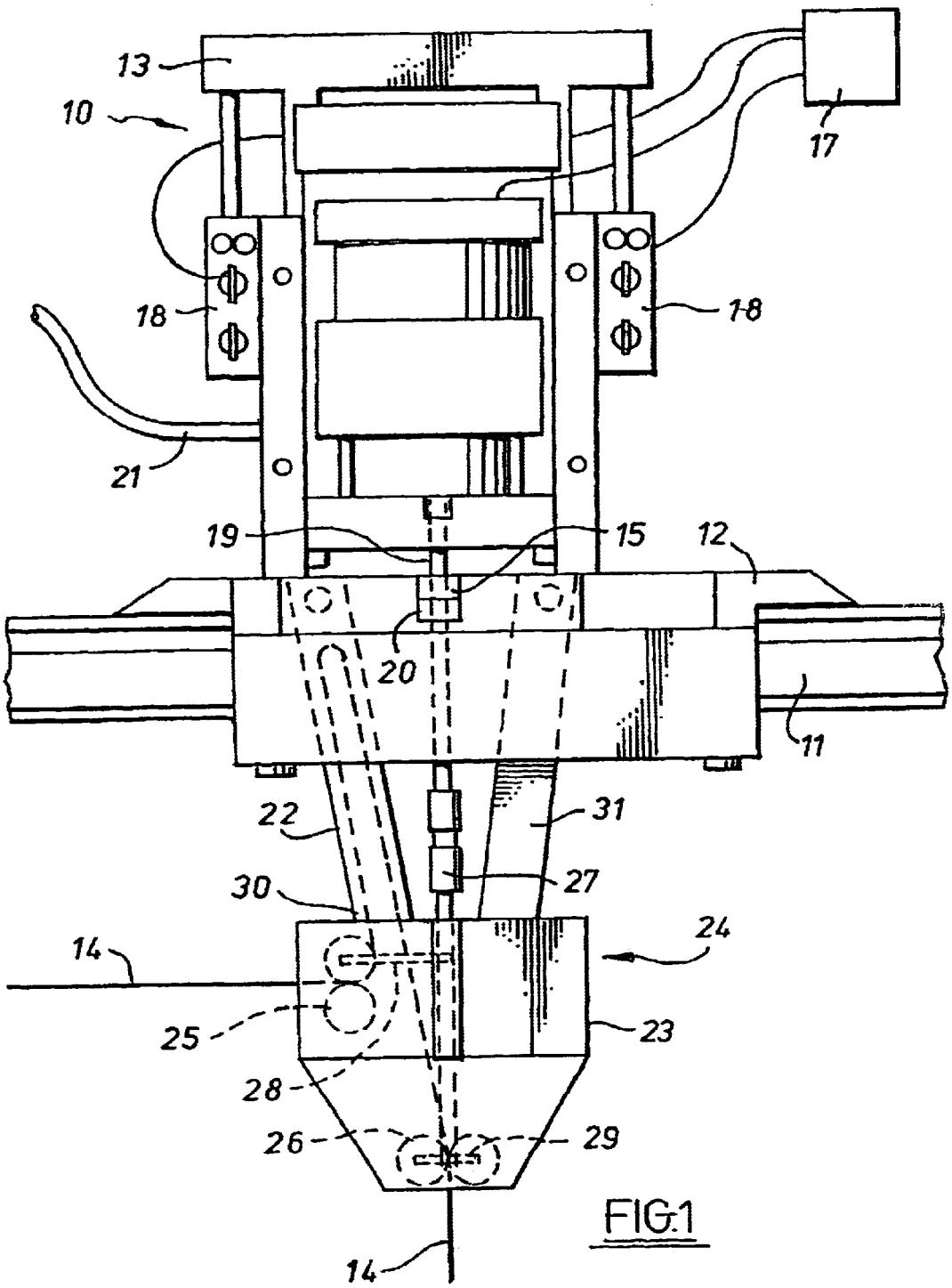
FIG. 1 is a diagrammatic see-through elevation of a first embodiment.

The drawings show a knitting machine 10 having a rail 11 along which a carrier 12 is mounted for movement therealong. The machine 10 also comprises a carriage (not shown for clarity), which in known knitting machines has a simple plunger (yarn carrier selector) to engage the carrier 12 to move the carrier along the rail 11. In this case, the simple plunger is replaced by a plunger unit 13. Mounted in the plunger unit 13 is a motor 16, which may be a precision servo motor or a stepper motor. The motor 16 has a shaft 19 at the end of which is a driving coupler 15. An electronic control arrangement 17 is operable to provide a yarn carrier selection signal and needle position and selection signals. The electronic control arrangement 17 may comprise microprocessors, micro controllers or digital signal processors. In response to the yarn carrier selection signal, the electro-pneumatic cylinders or solenoids 18, which are mounted in the carriage, are energised to retract the arms of the reciprocating plunger unit 13 to lower the plunger unit 13 to engage the selected carrier 12. The motor 16 in the plunger unit 13 is also lowered so that the driving coupler 15 on the shaft 19 of the motor 16 engages the receiving coupler 20 mounted in the carrier 12. At the same time, suction is applied to the carrier 12 via the pneumatic line 21.

Figure 2:
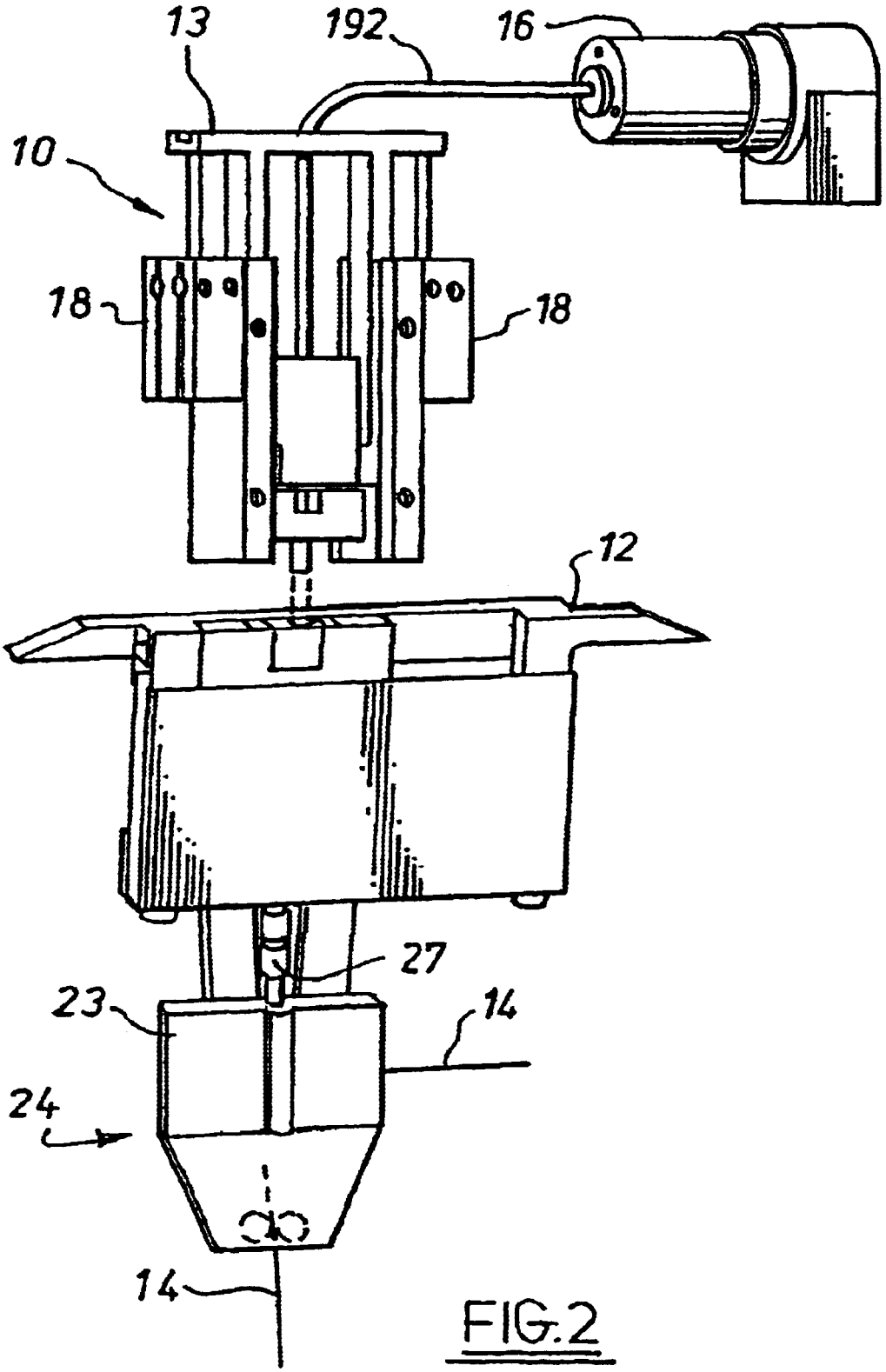
FIG. 2 is an elevation like FIG. 1 of a second embodiment.

The motor 16 may, as shown in FIG. 2, be mounted on the carriage (not shown) outside the plunger unit 13, drive being transmitted through a flexible drive shaft 192.

The carrier 12 has a yarn 14 passing therethrough to be withdrawn from a supply creel (not shown) and directed downwardly towards the needles (not shown) of the knitting machine 10. Mounted on the carrier 12 is a relaxation chamber 22, and a body 23 of the precision yarn delivery system 24. The chamber 22 has a rectangular cross-section 9 mm×4 mm, and is some 50–60 mm long. Within the body 23 are input feed rollers 25 and output feed rollers 26. The yarn 14 passes through the body 23, being withdrawn from the supply by the input feed rollers 25 and forwarded to the selected needles by the output feed rollers 26. A universal joint 27 connects the receiving coupler 20 with gears 28 coupled to the input feed rollers 25, and gears 29 coupled to the output feed rollers 26. In this way, the input feed rollers 25 and the output feed rollers 26 are driven by the motor 16 when the plunger unit 13 engages the carrier 12.

The input feed rollers 25 are positioned adjacent one end 30 of the chamber 22, which is in the form of an elongate tube, and the output feed rollers 26 are positioned spaced from that end 30 of the chamber 22. When the plunger unit 13 engages the carrier 12, the relaxation chamber 22 is positioned such that the suction in the pneumatic line 21 is applied to the chamber 22. Since suction is applied to the chamber 22, and the input feed rollers 25 are driven at a faster speed than the output feed rollers 26, the relaxing yarn 14 passing from the input feed rollers 25 to the output feed rollers 26 is held in the chamber 22. The applied suction is only sufficient to effect the untwisted holding of the relaxing yarn 14 and the best value for the section will be determined experimentally, or by experience from using the device depending on the kind of yarn being used. A typical value for the section is a small fraction of a bar. The cross-sectional dimensions of the tubular chamber 22 are chosen to allow the passage of the yarn 14 in a single loop as shown in the figure, but such that twisting and entangling of the yarn 14 is prevented.

The gears 28, 29 are chosen such that the input feed rollers 25 are driven at a desired faster speed than the output feed rollers 26. The difference in the speeds of the input feed rollers 25 and the output feed rollers 26 is chosen dependent on the elasticity of the yarn 14. The duration of engagement of the motor 16 with the receiving coupler 20 and the speed of the motor 16 are controlled by the electronic control arrangement 17, and the gearing 29 is chosen so that a precise length of yarn 14 is fed to the needles, resulting in a highly accurate stitch length.

A second relaxation chamber 31 assists in supporting the body 23, and provides that a second yarn may be passed through the body 23 to the needles of the knitting machine 10 if desired.

Although the embodiment of precision yarn delivery system described above is in relation to a flat bed knitting machine, it may be readily adapted for use with a circular knitting machine. The system accurately delivers predetermined lengths of elastomeric yarn, bulk yarn, such as torque stretch yarn, high modulus yarn or conventional yarn for knitwear to the needles of the knitting machine. Alternative embodiments of the precision yarn delivery system will be readily apparent to persons skilled in the art. For example, the yarn may be directed into the relaxation chamber by means of a jet of compressed air instead of the applied suction of the embodiment described.

What is claimed is:

1. A precision yarn delivery system for the delivery of yarn from a yarn supply to a yarn utilization point, the system having means for delivery precise lengths of yarn comprising a temporary yarn store intermediate the supply and the utilization point in which the yarn is held under a uniform substantially zero tension and is fed from the store as required by the utilization point.

2. The precision yarn delivery system of claim 1, wherein the yarn in the store is allowed to relax at a tension less than that at which it is withdrawn from the supply.

3. The precision yarn delivery system of claim 1, wherein the store comprises a chamber in which the yarn is stored.

4. The precision yarn delivery system of claim 3, wherein the yarn is stored in the chamber under pneumatic control.

5. The precision yarn delivery system of claim 4, wherein the pneumatic control is provided by suction applied to the chamber.

6. The precision yarn delivery system of claim 3, wherein the chamber comprises an elongate tube.

7. The precision yarn delivery system of claim 6, wherein the tube has a width to prevent twisting of the yarn therein.

8. The precision yarn delivery system of claim 3, wherein a yarn inlet to and a yarn outlet from the chamber are at one end of the chamber.

9. The precision yarn delivery system of claim 8, wherein the yarn is constrained to form a single loop in the chamber.

10. The precision yarn delivery system of claim 8, wherein a suction is applied to the chamber at the other end thereof.

11. The precision yarn delivery system of claim 8, further comprising an output feed device.

12. The precision yarn delivery system of claim 11, wherein the output feed device is disposed spaced from the yarn outlet from the chamber.

13. The precision yarn delivery system of claim 11, wherein the output feed device comprises a pair of feed rollers.

14. The precision yarn delivery system of claim 11, further comprising an input feed device.

15. The precision yarn delivery system of claim 14, wherein the input feed device is disposed adjacent the yarn inlet to the chamber.

16. The precision yarn delivery system of claim 14, wherein the input feed device comprises a pair of feed rollers.

17. The precision yarn delivery system of claim 14, wherein the input feed device and the output feed device are driven by a common drive arrangement.

18. The precision yarn delivery system of claim 17, wherein the input feed device is driven at a higher speed than the output feed device.

19. The precision yarn delivery system of claim 18, wherein the drive arrangement comprises gearing operable to determine the ratio of the speed of the input feed device to that of the output feed device.

20. The precision yarn delivery system of claim 19, wherein the gearing is selectable dependent on the elasticity of the yarn to be stored.

21. The precision yarn delivery system of claim 19, wherein a motor is disposed to drive the gearing.

22. The precision yarn delivery system of claim 21, wherein the motor is a precision servo motor.

23. The precision yarn delivery system of claim 21, wherein the motor is a stepper motor.

24. A knitting machine having a precision yarn delivery system for the delivery of yarn from a yarn supply to a knitting point, the system having means for delivering precise lengths of yarn comprising a temporary yarn store intermediate the supply and the knitting point in which the yarn is held under a uniform substantially zero tension and fed from the store as required by the knitting point.

25. The knitting machine of claim 24, which is a flat bed knitting machine.

26. The knitting machine of claim 25, further comprising a carriage operable to engage a selected carrier and to move the carrier along a rail of the machine in accordance with a signal from a control arrangement.

27. The knitting machine of claim 26, wherein the carrier has the precision yarn delivery system mounted thereon.

28. The knitting machine of claim 27, wherein the carriage has a plunger unit mounted thereon.

29. The knitting machine of claim 28, wherein the plunger unit has a motor and a coupler mounted thereon.

30. The knitting machine of claim 29, wherein the coupler is operable to engage a shaft of the motor with gearing of the precision yarn delivery system when the carriage is engaged with the carrier.

31. The knitting machine of claim 28, wherein the plunger unit is operated by means of electro-pneumatic cylinders.

32. The knitting machine of claim 28, wherein the plunger unit is operated by means of solenoids.

33. The knitting machine of claim 27, wherein suction is applied to the store whilst the carriage is in engagement with the carrier.

34. The knitting machine of claim 26, wherein the system comprises two stores and respective input feed devices, whereby two yarns may be fed to the knitting point.

* * * * *